United States Patent [19]

Scheidel

[11] 4,252,502

[45] Feb. 24, 1981

[54] RADIAL BLOWER ESPECIALLY FOR HEATERS AND AIR CONDITIONERS IN MOTOR VEHICLES

[75] Inventor: Wolfgang Scheidel, Bühl, Fed. Rep. of Germany

[73] Assignee: Robert Bosch GmbH, Stuttgart, Fed. Rep. of Germany

[21] Appl. No.: 9,044

[22] Filed: Feb. 2, 1979

[30] Foreign Application Priority Data

Feb. 21, 1978 [DE] Fed. Rep. of Germany ..... 2807273

[51] Int. Cl.[3] ..... F04D 29/44

[52] U.S. Cl. ..... 415/206; 415/219 C

[58] Field of Search ..... 415/204, 206, 207, 119, 415/219 C, 200

[56] References Cited

U.S. PATENT DOCUMENTS

| | | | |
|---|---|---|---|
| 1,014,321 | 1/1912 | Minor | 415/206 |
| 1,215,881 | 2/1917 | Siemen | 415/206 |
| 2,926,839 | 3/1960 | Hutt | 415/204 X |
| 3,018,896 | 1/1962 | Gewiss | 415/206 |
| 3,619,088 | 11/1971 | Bullock | 415/206 X |
| 3,752,603 | 8/1973 | Bunch | 415/200 X |
| 3,874,191 | 4/1975 | Hudson | 415/206 X |

FOREIGN PATENT DOCUMENTS

| | | | |
|---|---|---|---|
| 2747135 | 4/1978 | Fed. Rep. of Germany | 415/119 |

*Primary Examiner*—Leonard E. Smith

*Attorney, Agent, or Firm*—Michael J. Striker

[57] ABSTRACT

A radial blower, preferably for blowing air through a heat exchanger or air conditioner in a motor vehicle, mainly comprises an impeller wheel preferably directly driven by an electric motor, wherein the driven impeller wheel is mounted in a housing, the peripheral wall of which spirally approaches the outer periphery of the impeller wheel and passes at the outlet of the housing over in a so-called tongue delimiting the outlet at one side, in which the shortest distance between the outer periphery of the impeller wheel and the peripheral housing wall is located downstream of the tip of the tongue, as considered in the direction of rotation of the impeller wheel. The tip of the tongue is formed by a sector of a circular cylinder and the housing has between the region of the shortest distance of the housing wall from the circumference of the impeller wheel a planar wall portion which is tangential to the spirally formed portion of the housing and the sector of the circular cylinder forming the tip of the tongue.

11 Claims, 2 Drawing Figures

RADIAL BLOWER ESPECIALLY FOR HEATERS AND AIR CONDITIONERS IN MOTOR VEHICLES

BACKGROUND OF THE INVENTION

The present invention relates to a radial blower, especially for heaters and air conditioners in motor vehicles, such radial blowers include an impeller wheel, preferably driven by an electric motor, and mounted in a spiral housing, the wall of which approaches in form of a spiral the periphery of the rotating impeller wheel and passes over into a tongue delimiting the outlet of the radial blower at one side thereof. Such radial blowers are known in the art and they have a satisfactory efficiency, but they produce during operation an undesirable noise or a rather disturbing scream. This noise is substantially produced at the aforementioned tongue of the spiral housing. While it has been tried to solve this noise problem by enlarging the radial distance between the periphery of the impeller wheel and the wall of the spiral housing, this solution has the essential disadvantage that it leads to a decisive reduction of the efficiency of the radial blower. Furthermore, the outer dimensions of the spiral housing, especially in the region of the aforementioned tongue are necessarily increased, so that such radial blowers cannot be used in the interior of motor vehicles, in which the available space for such radial blowers is evidently rather limited.

SUMMARY OF THE INVENTION

It is an object of the present invention to provide a radial blower, especially for heaters and air conditioners in motor vehicles, which avoids the above-mentioned disadvantages of such radial blowers known in the art.

It is a further object of the present invention to provide a radial blower which is especially constructed to avoid production of a disagreeable noise during operation, while having a perfect efficiency and without essentially increasing the outer dimensions of the blower.

With these and other objects in view, which will become apparent as the description proceeds, the radial blower according to the present invention, especially for heaters and air conditioners in motor vehicles, mainly comprises a housing having a spirally-shaped peripheral wall, a lateral outlet in the peripheral wall and a central inlet, a driven impeller wheel mounted in the housing for rotation about its axis in one direction, in which the peripheral wall of the housing is arranged to spirally approach the outer diameter of the impeller wheel and to pass over into a tongue delimiting the outlet at one side thereof and forming at the transition from the peripheral wall to the outlet a tip of the tongue, wherein the shortest distance between the outer diameter of the impeller wheel and the peripheral wall of the housing is located downstream of the tip of the tongue, as considered in the direction of rotation of the impeller wheel.

The impeller wheel is preferably driven by an electric motor located in the housing coaxial with the impeller wheel for rotating the same about its axis.

The aforementioned tip of the tongue is formed by a segment of a circular cylindrical wall portion and the peripheral wall of the housing has between the aforementioned tongue and the location of the shortest distance between the peripheral housing wall and the outer diameter of the impeller wheel a planar wall portion tangential to the spirally-shaped peripheral wall and to the cylindrical segment forming the tip of the tongue.

Preferably the planar wall portion extends over an angle of the impeller wheel which is between 10° and 30°. The shortest distance measured in the radial direction of the impeller wheel is preferably equal to 10–20% of the radius of the latter.

The housing is preferably constructed of two interengaging, superimposed parts of plastic material, meeting in a plane normal to the axis of the impeller wheel. This feature permits to form the housing in an efficient manner by injection molding.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 2:
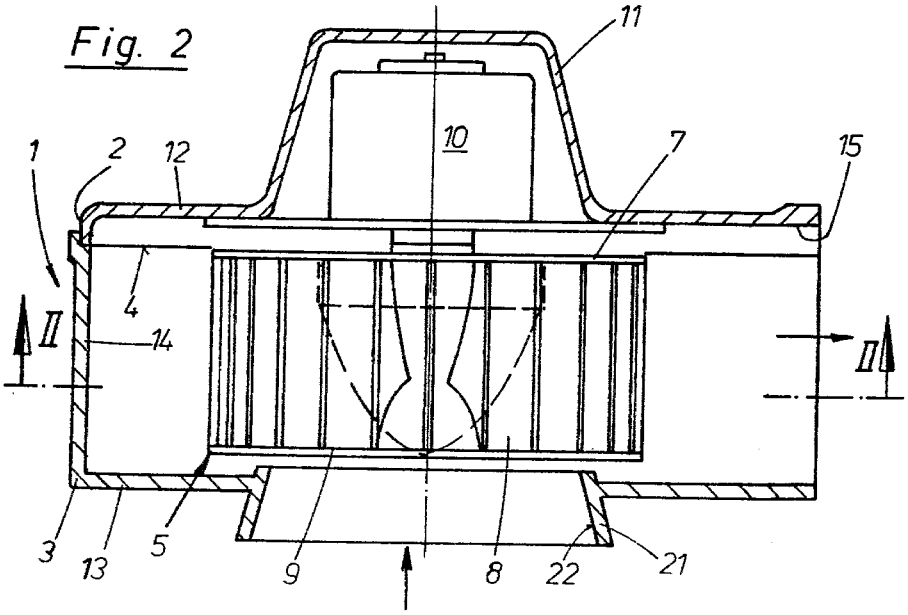
FIG. 2 is a vertical cross-section taken along the line II—II of FIG. 1.

Referring now to the drawing, it will be seen that the radial blower according to the present invention has a spiral housing 1, composed of two superimposed, interengaging housing parts 2 and 3 meeting along a plane 4, which is normal to the axis of the impeller wheel 5 mounted in the housing 1 for rotation about its axis. The impeller wheel 5 has a paraboloidal hub 6, projecting downwardly from a planar disk 7 at the upper end of the impeller wheel. A plurality of substantially radially extending vanes 8 project, circumferentially equally spaced from each other, substantially normal to, downwardly from the disk 7 and engage at the lower end thereof a ring member 9, coaxial with the axis of the impeller wheel. The ring 9 and the disk 7 have the same outer diameter R and the vanes 8 extend from the hub 6 up to the aforementioned outer diameter. An electric motor 10 for driving the impeller wheel 5 is located in an upwardly extending central hollow bulge 11 of the housing part 2 and connected to the latter in any suitable manner, as schematically illustrated in FIG. 2. The output shaft of the motor 10, not shown in the drawing, is fixedly connected to the hub 6 of the impeller wheel 5 for driving the latter.

Figure 1:
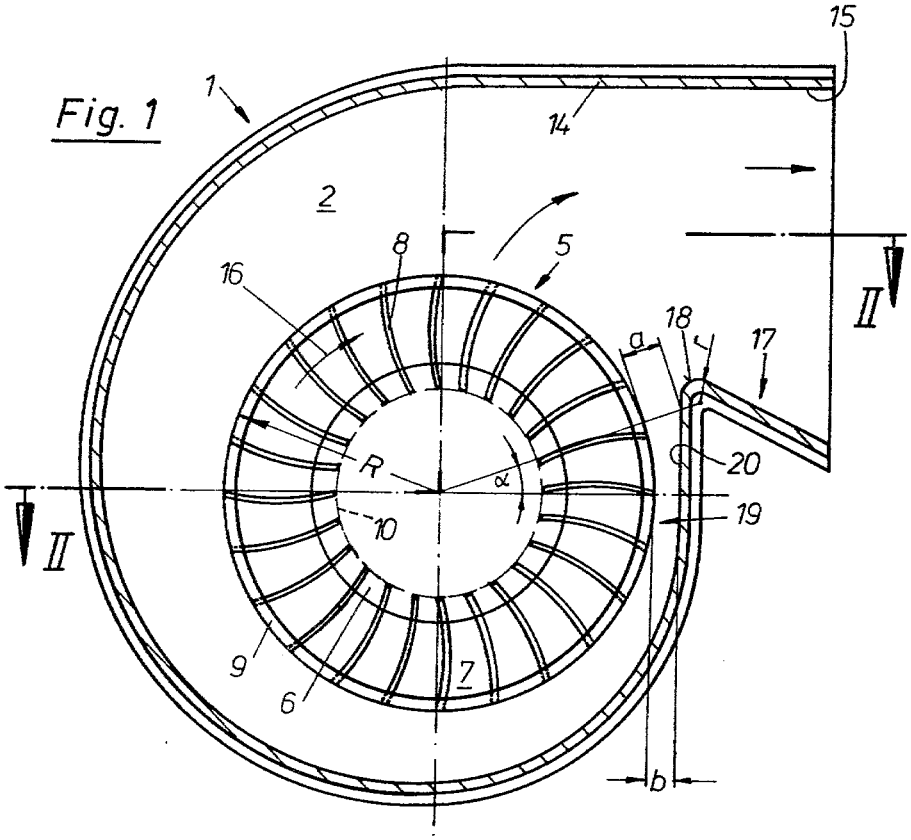
FIG. 1 is a horizontal cross-section through the radial blower according to the present invention, taken along line I—I of FIG. 2.

The housing part 2 has a substantially planar top wall 12, from which the aforementioned bulge 11 projects upwardly, and the housing part 3 has a substantially planar bottom wall 13 with a central funnel-shaped portion 21, which forms the air inlet 22 of the housing 1. The wall portions 12 and 13 are connected to each other by a peripheral wall 14 normal thereto. As can be seen from FIG. 1, this wall 14 extends along a spiral. The region of the wall 14 which in radial direction is farthest spaced from the outer periphery of the impeller wheel 5 starts at the outlet 15, which extends essentially tangential to the impeller wheel 5, and the wall 15 gradually approaches, in a direction opposite to the direction of rotation of the impeller wheel indicated by the arrow 16, the peripheral surface of the impeller wheel 5. Finally, the wall 14 passes over into a tongue 17 delimiting the outlet 15 on the other side thereof. The tongue 17 has a tip 18 formed by a segment of a circular cylinder with the radius r. This radius r is shown in the drawing as being 0.15 of the radius R of the impeller wheel 5, but the radius r can also be smaller, for instance up to 0.1 R.

The narrowest passage portion 19, at which the radial distance b between the outer periphery of the impeller wheel 5 and the wall 14 is smallest, is located downstream of the tip 18 of the tongue 17, as viewed in the direction of rotation of the impeller wheel indicated by the arrow 16. The radial distance between the wall 14 and the outer periphery of the impeller wheel 5 increases from the narrowest portion 19 to opposite sides of the latter. The wall 14 of the housing has between the location of the aforementioned narrowest distance and the tip 18 of the tongue 17 a planar wall portion 20 which extends through an angle $\alpha$ of the impeller wheel of substantially 20°. It has, however, been shown that, if this planar wall portion extends over an angle of a minimum of 10°, good results with respect to efficiency and noise reduction are still obtained. The radial distance a between the peripheral surface of the impeller wheel 5 and the end of the planar wall portion 20 at the tip 18 of the tongue is about 0.25 R. The dimensions a and b mentioned above may be varied within certain limits depending on the desired noise reduction, the available mounting space and the required throughput of the blower, and it has been shown that good results may be obtained if a is equal to 0.2–0.3 of R and b is equal to 0.1–0.2 of R.

The planar wall portion 20 is tangential at one end to the above-mentioned spirally formed housing wall 14 and at the other end also tangential to the cylindrical sector forming the tip 18 of the tongue 17.

When the impeller wheel 5 is rotated by the electric motor 10, air is sucked in through the inlet 22 and is driven out in known manner through the outlet 15. Through the specific construction of the spiral housing a high efficiency of the blower is obtained while the noise produced during the operation of the blower is held to a minimum. The disadvantages of known steps for obtaining a reduced noise during operation are avoided with the specific construction according to the present invention and the housing of the radial blower according to the present invention can be manufactured at very reasonable cost by injection molding.

It will be understood that each of the elements described above, or two or more together, may also find a useful application in other types of radial blowers differing from the types described above.

While the invention has been illustrated and described as embodied in a radial blower, especially for heaters and air conditioners in motor vehicles having a high efficiency and considerable reduction of noise during operation, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A radial blower, especially for heaters and air conditioners in motor vehicles, comprising a housing having a spirally-shaped peripheral wall, a lateral outlet in said peripheral wall and a central inlet; a driven impeller wheel mounted in said housing for rotation about its axis in one direction, said peripheral wall of said housing being arranged to spirally approach the outer diameter of the impeller wheel and to pass over into a tongue delimiting the outlet at one side thereof and forming at the transition from said peripheral wall to said outlet a tip of said tongue, wherein the shortest distance between the outer diameter of the impeller wheel and the peripheral wall of the housing is located downstream of the tip of the tongue, as considered in the direction of rotation of the impeller wheel, and wherein said shortest distance measured in the radial direction of the impeller wheel is equal to 10–20% of the radius of the impeller wheel.

2. A radial blower, especially for heaters and air conditioners in motor vehicles, comprising a housing having a spirally-shaped peripheral wall, a lateral outlet in said peripheral wall and a central inlet; a driven impeller wheel mounted in said housing for rotation about its axis in one direction, said peripheral wall of said housing being arranged to spirally approach the outer diameter of the impeller wheel and to pass over into a tongue delimiting the outlet at one side thereof and forming at the transition from said peripheral wall to said outlet a tip of said tongue, wherein the shortest distance between the outer diameter of the impeller wheel and the peripheral wall of the housing is located downstream of the tip of the tongue, as considered in the direction of rotation of the impeller wheel, wherein said tip of said tongue is formed by a segment of a circular cylindrical wall portion, wherein said peripheral wall has between said tongue and the location of the shortest distance between the peripheral housing wall and the outer diameter of said impeller wheel a planar wall portion tangential to the spirally-shaped peripheral wall, wherein said planar wall portion is also tangential to the cylindrical segment forming the tip of the tongue, and wherein the radial distance of the peripheral wall of the housing from the outer periphery of the impeller wheel at the transition of said planar wall portion to said cylindrical segment is equal to 20–30% of the radius of the impeller wheel.

3. A radial blower, especially for heaters and air conditioners in motor vehicles, comprising a housing having a spirally-shaped peripheral wall, a lateral outlet in said peripheral wall and a central inlet; a driven impeller wheel mounted in said housing for rotation about its axis in one direction, said peripheral wall of said housing being arranged to spirally approach the outer diameter of the impeller wheel and to pass over into a tongue delimiting the outlet at one side thereof and forming at the transition from said peripheral wall to said outlet a tip of said tongue, wherein the shortest distance between the outer diameter of the impeller wheel and the peripheral wall of the housing is located downstream of the tip of the tongue, as considered in the direction of rotation of the impeller wheel, wherein said tip of said tongue is formed by a segment of a circular cylindrical wall portion, and wherein the radius of said cylindrical segment forming the tip of the tongue is equal to 10–20% of the radius of the impeller wheel.

4. A radial blower, especially for heaters and air conditioners in motor vehicles, comprising a housing having a spirally-shaped peripheral wall, a lateral outlet in said peripheral wall and a central inlet; a driven impeller wheel mounted in said housing for rotation about its axis in one direction, said peripheral wall being arranged to spirally approach the outer diameter of the impeller wheel, the spirally-shaped peripheral wall ending at a point at which it is at the shortest distance from the outer diameter of the impeller wheel and passing over from said point of shortest distance into a planar wall portion tangential to said spirally-shaped peripheral wall, said planar wall portion, in turn passing over into a tongue delimiting the outlet and forming at the transition from said planar wall portion to said outlet a tip of said tongue, said point of shortest distance between the outer diameter of the impeller wheel and the spirally-shaped peripheral wall being located downstream of the tip of the tongue as considered in the direction of rotation of the impeller wheel.

5. A radial blower as defined in claim 4, wherein said tip of said tongue is formed by a segment of a circular cylindrical wall portion.

6. A radial blower as defined in claim 4, wherein said planar wall portion extends over an angle $\alpha$ of the impeller wheel of a magnitude of 10°–30°.

7. A radial blower as defined in claim 4, wherein said planar wall portion is also tangential to the cylindrical segment forming the tip of said tongue.

8. A radial blower as defined in claim 4, and including an electric motor in said housing coaxial with said impeller wheel for rotating the latter about its axis.

9. A radial blower as defined in claim 8, wherein said housing is constructed of two interengaging superimposed parts of plastic material, each having an end wall substantially normal to said peripheral wall and wherein the end wall of the upper of said superimposed parts is provided with a central upwardly projecting hollow bulge in which said electric drive motor is located.

10. A radial blower as defined in claim 4, wherein said housing is constructed of two interengaging, superimposed parts of plastic material meeting in a plane substantially normal to the axis of said impeller wheel.

11. A radial blower as defined in claim 10, wherein each of said parts has an end wall substantiall-normal to said peripheral wall and wherein said inlet is in the form of a funnel in the end wall of the lower of the superimposed part.

* * * * *